United States Patent [19]

Brinkman

[11] Patent Number: 4,617,816

[45] Date of Patent: Oct. 21, 1986

[54] THREAD ROLLING ATTACHMENT

[75] Inventor: Robert J. Brinkman, Rush, N.Y.

[73] Assignee: C. J. Winter Machine Works, Rochester, N.Y.

[21] Appl. No.: 698,540

[22] Filed: Feb. 5, 1985

[51] Int. Cl.[4] ..... B21H 3/04

[52] U.S. Cl. ..... 72/104; 72/108; 72/452

[58] Field of Search ..... 72/104, 108, 452; 92/13.6

[56] References Cited

U.S. PATENT DOCUMENTS

| | | | |
|---|---|---|---|
| 2,679,773 | 6/1954 | Scott | 72/104 |
| 3,048,064 | 8/1962 | Hofer | 72/104 |
| 3,772,907 | 11/1973 | Rider | 72/452 |
| 3,972,218 | 8/1976 | Pawloski | 72/452 |
| 4,045,988 | 9/1977 | Anderson | 72/108 |
| 4,426,869 | 1/1984 | Farmer et al. | 72/104 |

FOREIGN PATENT DOCUMENTS

| | | | |
|---|---|---|---|
| 2654588 | 7/1977 | Fed. Rep. of Germany | 92/13.6 |
| 2231873 | 12/1974 | France | 92/13.6 |

*Primary Examiner*—Lowell A. Larson

*Attorney, Agent, or Firm*—Shlesinger, Fitzsimmons & Shlesinger

[57] ABSTRACT

An outboard thread rolling attachment for an automatic screw machine for rolling a pattern on a workpiece comprising:

a roll arm yoke; a pair of roll arms supported by the yoke end diametrically opposed to each other relative to the axis of rotation of a workpiece placed therebetween; each roll arm having a rotatable shaft with a thread roll positioned at the lower end of each shaft; fluid pressure means including a first cylinder element, a first piston element and a wedge element connected to the roll arm yoke and in contact with and operable on and between the inner end of the roll arm.

The first piston element comprises a second movable cylinder element and a second piston element having adjustment means for adjusting the travel of the wedge element.

10 Claims, 4 Drawing Figures

4
120
118
132
130
110
A
10
128
82
88
86
80
84
92
90
78
94
19
18
136
30
12
14
40
W
2
42
16
32

4
118
120
A
110
6
10
8
10'
136
19
14
50
46
32
31
38
36
39
34
37
42
44
2

THREAD ROLLING ATTACHMENT

BACKGROUND OF THE INVENTION

The present invention relates to the field of thread rolling, and more particularly to a thread rolling attachment for an automatic screw machine and to the operation of such attachment.

Present thread rolling attachments generally accommodate a limited range of thread sizes. Where thread rolling attachments are adaptable to a wider selection of thread sizes, they are modified by extensive and complex adjustment cams.

In general, the prior art developments such as in U.S. patents Laemmel No. 2,933,955, Brinkman No. 2,987,945, Hoser No. 3,048,064 and Betker No. 3,314,262 are typical.

The taper adjustment of this attachment is accomplished by a taper adjusting bolt through a split yoke. The fulcrum pins for the thread roll arms are mounted in spherical bearings which allow them to readily align themselves for whatever taper is set.

The primary reason for this is that outboard attachments historically have been prone to disalignment causing tapered threads and all the inherent problems involved.

This taper adjustment allows compensation for the inherent spring in the entire assembly when the rolls are mounted outboard.

SUMMARY AND OBJECTS OF THE INVENTION

The primary object of the present invention is to provide an improved thread rolling attachment which can be adjusted to accommodate a broad range of thread sizes.

Another object of this invention is to provide a thread rolling attachment which is simple and inexpensive to manufacture.

Yet another object of this invention is to provide a thread rolling attachment which is reliable.

Still a further object of this invention is to provide a thread rolling attachment which is easy to assemble and maintain.

Yet another object of this invention is to provide a thread rolling attachment of positive action at all times to maintain accuracy.

Another further object of this invention is to provide a thread rolling attachment which is durable because of its carbide sleeves.

Still another object of this invention is to provide a thread rolling attachment which maintains the thread rollers angularly aligned at a desired pitch at all times preventing irregular, lapssided, off centeredtaper in the cut threads.

A further object of this invention is to provide a thread rolling attachment which allows for compensation for the spring in the entire assembly thus providing greater accuracy in screw manufacture.

Another object of this invention is to provide a thread rolling attachment of fine adjustment which can be monitored and readily indexed.

A further object of this invention is to provide a thread rolling attachment which is compact.

Still another object of this invention is to provide a thread rolling attachment which is readily adaptable to machine use.

These and other objects and advantages of the present invention will become apparent in view of the accompanying specification and drawings.

DESCRIPTION

Figure 1:
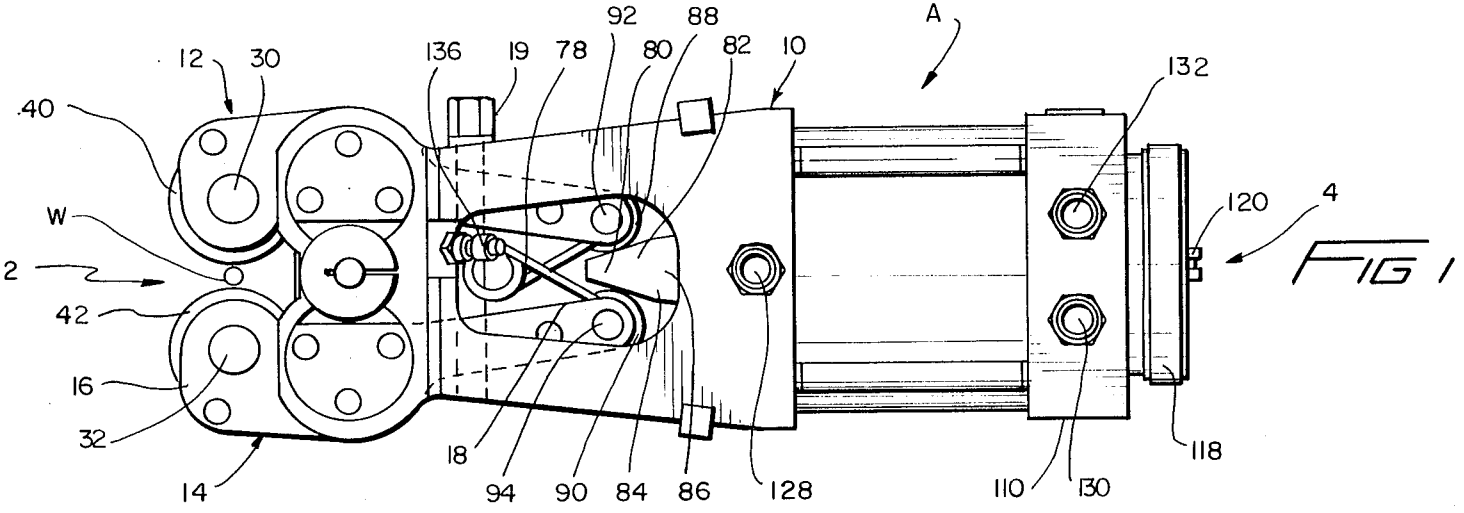
FIG. 1 is a top plan view of the thread rolling attachment.
Figure 2:
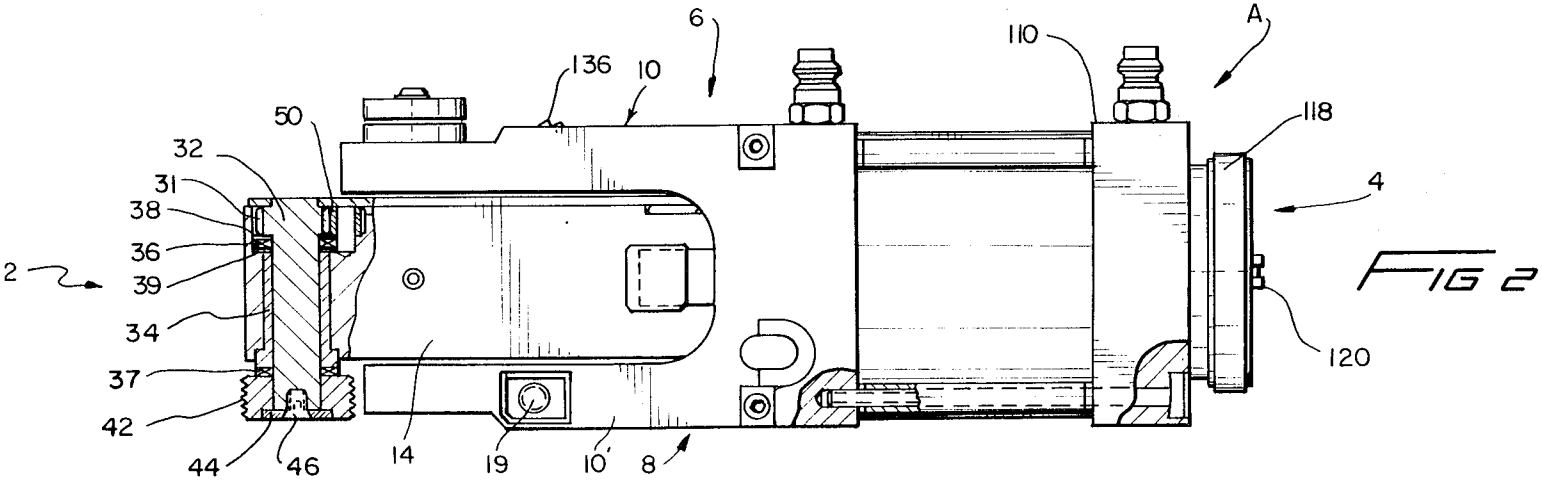
FIG. 2 is a side elevational view of the thread rolling attachment with portions broken away.
Figure 3:
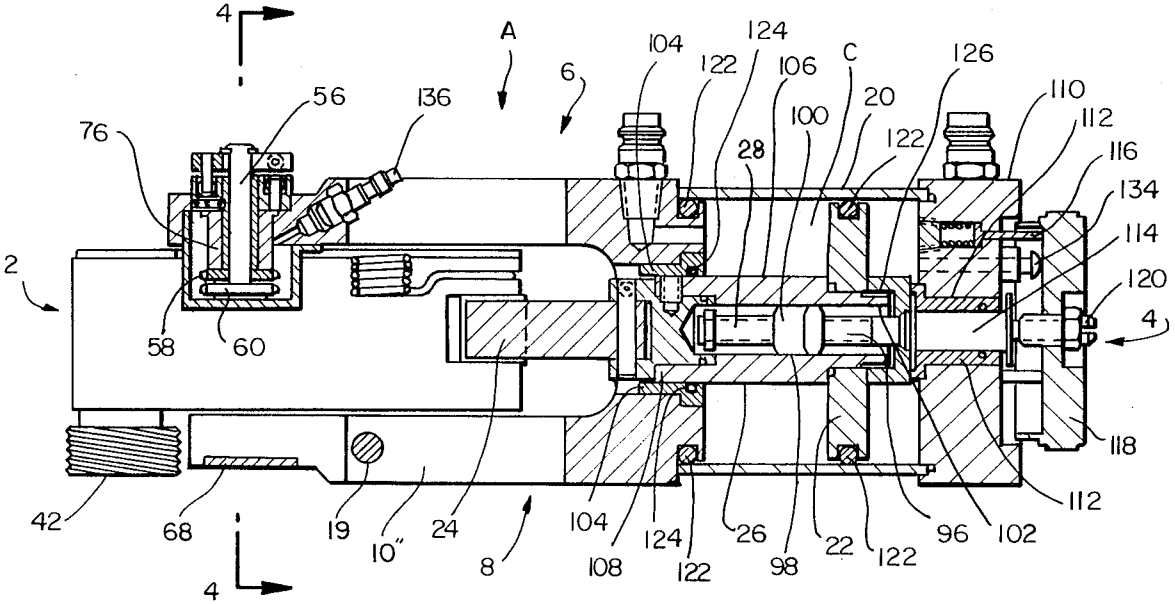
FIG. 3 is a side elevational view of the thread rolling attachment with portions broken away.
Figure 4:
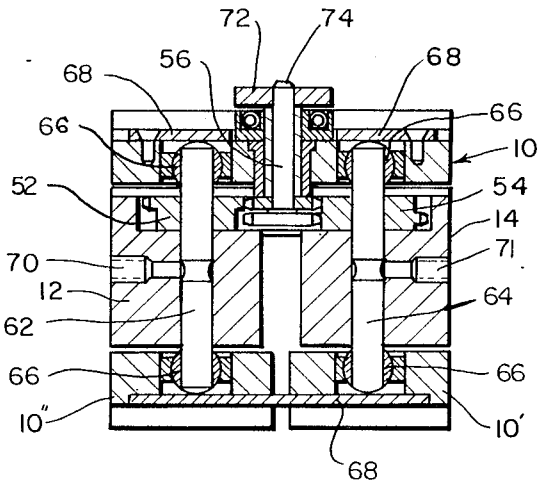
FIG. 4 is a cross section of the thread rolling attachment taken along the line 4—4 of FIG. 1 and viewed in the direction of the arrows.

Referring now to FIGS. 1–4, the thread rolling attachment A is comprised of a front section 2, a rear section 4, an upper section 6 and a lower section 8.

Front section 2 includes a roll arm yoke 10 supporting a pair of roll arms 12 and 14. Each roll arm 12 and 14 comprises an outer end 16 and an inner end 18.

Lower section 8 of yoke 10 is split into two sections 10' and 10'' interconnected by a taper adjusting bolt 19 that is adjustable to position roll arms 12 and 14 for a purpose hereinafter described.

Rear section 4 includes a fluid pressure cylinder means C having a first cylinder element 20, a first piston element 22 and a wedge element 24. The first cylinder element 20 comprises a second movable cylinder element 26 and a second stationary piston element 28.

The fluid pressure cylinder means C is connected to the roll arm yoke 10 and is in contact with and operable on and between the inner end 18 of each roll arm 12 and 14.

A roll support shaft 30 and 32, each of which has a spur gear 31 integral with one end thereof, is positioned in each roll arm 12 and 14 and rotatable in a roll arm bushing 34 made out of carbide. Each roll arm bushing 34 has upper and lower thrust bearings 36 and 37. Thrust bearing 36 includes thrust bearing races 38 and 39.

Thread rolls 40 and 42 are located at the lower end of each roll support shaft 30 and 32 and have a support shaft drive adapter 44 that is held in place by a drive adapter screw 46. The thread rolls 40 and 42 are diametrically opposed to each other relative to the axis of rotation of a workpiece W placed therebetween. Adjustment of the bolt 19, tilts the roll axes relative to each other through the use of reverse threads on bolt 19 or other common adjustment means (not shown).

Roll support shafts 30 and 32 are interconnected to each other by idler gears 48 and 50 which are incorporated at the upper end of each roll support shaft 30 and 32 to mesh with the spur gears 31. Idler gears 48 and 50 are engaged with idler gears 52 and 54. Idler gears 52 and 54 are commonly engaged by a dual gear shaft 56. The dual gear shaft 56 comprises an external compensator gear 58 and an internal compensator gear 60.

Idler gears 52 and 54 are mounted to fulcrum pins 62 and 64 for the arms 12 and 14. Fulcrum pins 62 and 64 are supported by spherical bearings 66 at both ends and held in place by thrust plates 68. Fulcrum pins 62 and 64 are locked by screws 70 and 71.

An adjusting collar 72 is positioned in the top of the dual gear shaft 56 and held in place by a retaining ring 74. Dual gear shaft 56 is mounted on a compensator bushing 76.

The roll arm yoke 10 includes a roll arm spring 78 of a scissors configuration and is mounted above the wedge element 24. Wedge 24 has a narrow portion 80, a medium portion 82 and a large portion 84 located at its front section 86. Wedge 24 makes contact with rollers 88 and 90 that are positioned at the inner end 18 of roll arms 12 and 14.

Rollers 88 and 90 are fastened by pins 92 and 94.

The second stationary piston element 28 includes a rotatable portion 96 and a non-rotatable portion 98. The rotatable portion 96 is cylindrical in shape and the non-rotatable portion 98 includes a second piston adjusting nut 100 having an internal bore adapted for receiving the rotatable portion 96 and and external surface which is rectangular in shape. The second movable cylinder 26 includes an internal surface 102 which is rectangular in shape and receives the second piston adjusting nut 100 that is used to set the proper travel adjustment of the second movable cylinder element 26.

The first cylinder element 20 includes a bearing sleeve 104 positioned in the cylinder shaft 106 that receives the front section 108 of the first piston element 22.

End plate 110 is located in the rrear section 4 of the thread rolling attachment A. Bushing 112 is positioned inside end plate 110 and receives the rear section 114 of the first piston element 22. End plate 110 includes an index plunger 116, that in combination with adjusting knob 118, is used to set the proper adjustment of the second stationary piston element 28. Adjusting screw 120 is used to set the travel of adjusting nut 100.

First piston element 22 includes "O" rings 122 that are provided for allowing sliding contact with the first cylinder element 20. "O" ring 124 is positioned in the cylinder shaft 106 and inside a recess in bushing 104. First piston element 22 includes retaining nut 126 that limits its travel during backward movement.

The thread rolling attachment A includes quick change adapters 128, 130 and 132 located in the rear upper section of the attachment A.

Quick change adapters 128 and 130 are provided for injecting fluid to the attachment A, while quick change adapter 132 is provided to release fluid from the attachment A. Pilot valve 134 is provided also for the same purpose of releasing fluid from the attachment A.

Quick disconnect plug 136 is located in the front upper section of the attachment A mounted next to the dual gear shaft 56 in order to provide lubricant to dual gear shaft 56.

OPERATION

In operation, the thread rolling attachment A is set to the proper travel adjustment of the first piston element 22 by adjusting screw 120. Screw 120 moves adjusting nut 100 along the second stationary piston element 28. This regulates travel of wedge 24 between the inner edge 18 of roll arms 12 and 14 permitting expansion of the outer end 16 of roll arms 12 and 14 to insure proper threading of workpiece W.

Injection of fluid through quick change adapters 128 and 130 causes axial stroking of the first piston element 22, which enables displacement of wedge 24 between roll arms 12 and 14 acting through rollers 88 and 90. This displacement permits expansion of roll arms 12 and 14 as desired and allows them to produce different thread sizes.

After the rotating workpiece W is positioned between the roll arm 12 and 14, idler gears 50, 52, 54 and 56 in combination with dual gear shaft 56 determines rotation of roll arms 12 and 14 causing threading of workpiece W by thread rolls 40 and 42. Taper adjustment is provided in attachment A by the spherical bearings 66 and the taper adjusting bolt 19 which allows the axes of fulcrum pins 62 and 64 to be tilted relative to one another as may be necessary to compensate for the inherent spring in the entire assembly when the rolls 40 and 42 are mounted outboard the workpiece W. This may, of course, require the substitution of a thrust plate 68 of different width in place of the plate shown in FIG. 4 between yolk sections 10' and 10''.

While this invention has been described as having a preferred design, it is understood that it is capable of further modifications, uses and/or adaptations of the invention following in general the principle of the invention and including such departures from the present disclose as come within known or customary practice in the art to which the invention pertains, and as may applied to the central features hereinbefore set forth, and fall within the scope of the invention of the limits of the appended claims.

What is claimed is:

1. An outboard thread rolling attachment for an automatic screw machine for rolling a pattern on a workpiece comprising:

(a) a roll arm yoke having two, spaced, parallel arms, one of which is split into two sections, (b) a pair of roll arms pivotally supported intermediate their ends on a pair of spaced, generally parallel fulcrum pins which extend transversely between the arms of said yoke, (c) each of said roll arms having an inner end and an outer end, (d) each of said outer ends of said roll arms having a shaft rotatably mounted thereon, (e) a thread roll fixed on each of said shafts adjacent one end thereof, (f) said rolls being diametrically opposed to each other relative to the axis of rotation of a workpiece placed therebetween, (g) each of said shafts having gear means interconnecting one shaft with the other shaft, (h) a fluid pressure cylinder means including reciprocable piston means, and wedge means operatively connected to said piston means for reciprocation thereby, and being in contact with and operable on and between the inner ends of said roll arms, (i) said piston means including means for adjusting the travel of said wedge means, (k) means mounting opposite ends of said fulcrum pins in the arms of said yoke for limited universal movement relative thereto, and (l) taper adjusting means interconnecting said two sections of said one arm of said yoke and adjustable to tilt the axes of said fulcrum pins relative to one another.

2. An outboard thread rolling attachment, as in claim 1 and wherein (a) said gear means includes a gear fixed to each of said shafts adjacent the opposite end thereof.

3. An outboard thread rolling attachment, as in claim 1 and wherein:

(a) said roll arm yoke includes spring means (b) said spring means having a scissors configuration, and (c) said spring means are mounted above said wedge means.

4. An outboard thread rolling attachment as in claim 1, wherein:

(a) said piston means includes first and second piston means reciprocable in first and second cylinders, respectively, (b) said second cyulinder is fixed to said first piston means, and (c) said adjusting means includes indexing means manually operable from the exterior of said first cylinder for effecting adjustment of said second piston means relative to said second cylinder.

5. An outboard thread rolling attachment as in claim 4 and wherein:

(a) said second piston means includes a portion rotatable relative to said second cylinder and a non-rotatable portion, and said rotatable portion is cylindrical in shape.

6. An outboard thread rolling attachment as in claim 5 and wherein:

(a) said non-rotatable portion comprises a adjusting nut having an internal bore adapted for receiving said rotatable portion.

7. An outboard thread rolling attachment as in claim 6 and wherein:

(a) said adjusting nut includes an external surface which is rectangular in shape.

8. An outboard thread rolling attachment as in claim 7 and wherein:

(a) said second cylinder includes an internal surface which is rectangular in shape and receives said adjusting nut.

9. An outboard thread rolling attachment as in claim 1 and wherein:

(a) said thread roll shafts each include intermediate its ends a carbide bushing for rotation of said shaft therein.

10. An outboard thread rolling attachment as in claim 1 and wherein said mounting means comprises a spherical bearing supporting each end of each of said fulcrum pins to permit angular displacement thereof by adjustment of said taper adjusting means.

* * * * *